United States Patent [19]

Kar et al.

[11] Patent Number: 4,907,665

[45] **Date of Patent: * Mar. 13, 1990**

[54] CAST STEEL ROCK BIT CUTTER CONES HAVING METALLURGICALLY BONDED CUTTER INSERTS

[75] Inventors: Naresh J. Kar, Westminster; William J. Salesky, Irvine; Steven J. Guzowski, Costa Mesa, all of Calif.

[73] Assignee: Smith International, Inc., Houston, Tex.

[ * ] Notice: The portion of the term of this patent subsequent to Aug. 4, 2004 has been disclaimed.

[21] Appl. No.: 297,504

[22] Filed: Jan. 13, 1989

Related U.S. Application Data

[63] Continuation-in-part of Ser. No. 76,510, Jul. 22, 1987, abandoned, which is a continuation of Ser. No. 897,947, Aug. 19, 1986, abandoned, which is a continuation of Ser. No. 655,140, Sep. 27, 1984, abandoned.

[51] Int. Cl.[4] ..... E21B 10/46

[52] U.S. Cl. ..... 175/410; 51/293; 76/101 E; 76/108 A

[58] Field of Search ..... 175/409, 410, 411; 76/108 A, 108 R, 101 A, 101 R, 101 E, DIG. 11; 164/97; 299/91; 51/293

[56] References Cited

U.S. PATENT DOCUMENTS

| | | | |
|---|---|---|---|
| 1,926,770 | 9/1933 | Harris et al. | 23/202 |
| 3,294,186 | 12/1966 | Buell | 175/410 |
| 3,970,158 | 7/1976 | Black et al. | 175/410 |
| 4,372,404 | 2/1983 | Drake | 175/410 |
| 4,389,074 | 6/1983 | Greenfield | 299/79 |
| 4,423,646 | 1/1984 | Bernhardt | 164/97 |
| 4,484,644 | 11/1984 | Cook et al. | 175/410 |
| 4,505,721 | 3/1985 | Almond et al. | 175/410 |
| 4,593,776 | 7/1986 | Salesky et al. | 175/375 |
| 4,595,067 | 6/1986 | Drake | 175/411 |
| 4,683,781 | 8/1987 | Kar et al. | 76/108 A |

*Primary Examiner*—Bruce M. Kisliuk

*Attorney, Agent, or Firm*—Robert G. Upton

[57] ABSTRACT

Tools, and particularly rock bit cutter cones, having "hard" cermet cutter inserts enveloped in an intermediate layer or coating of a suitable high melting metal, and embedded in a cast steel matrix are disclosed. The cermet inserts, which usually comprise tungsten carbide in a cobalt phase (WC-Co), are coated with a layer of a metal or metal alloy, preferably nickel, which does not substantially melt during the subsequent step of casting the steel matrix of the tool. An additional layer of copper is advantageously employed on the cermet insert beneath the layer of the high melting metal, such as nickel. The coated inserts are held in appropriate position in a suitable mold and the steel matrix of the tool is poured from molten metal. The coatings on the cermet inserts prevent thermal shock to the inserts, prevent deterioration of the cermet due to diffusion of carbon into the adjacent steel, and metallurgically bonding and embedding the inserts to the steel matrix.

9 Claims, 2 Drawing Sheets

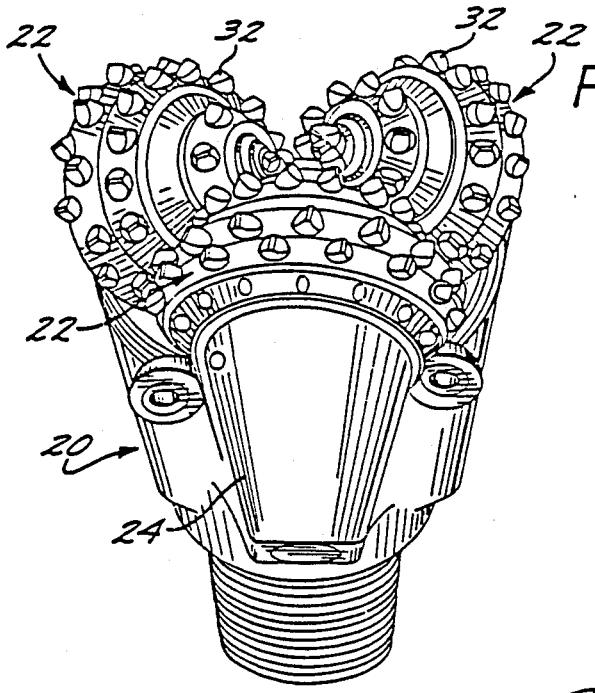
FIG. 1
FIG. 2
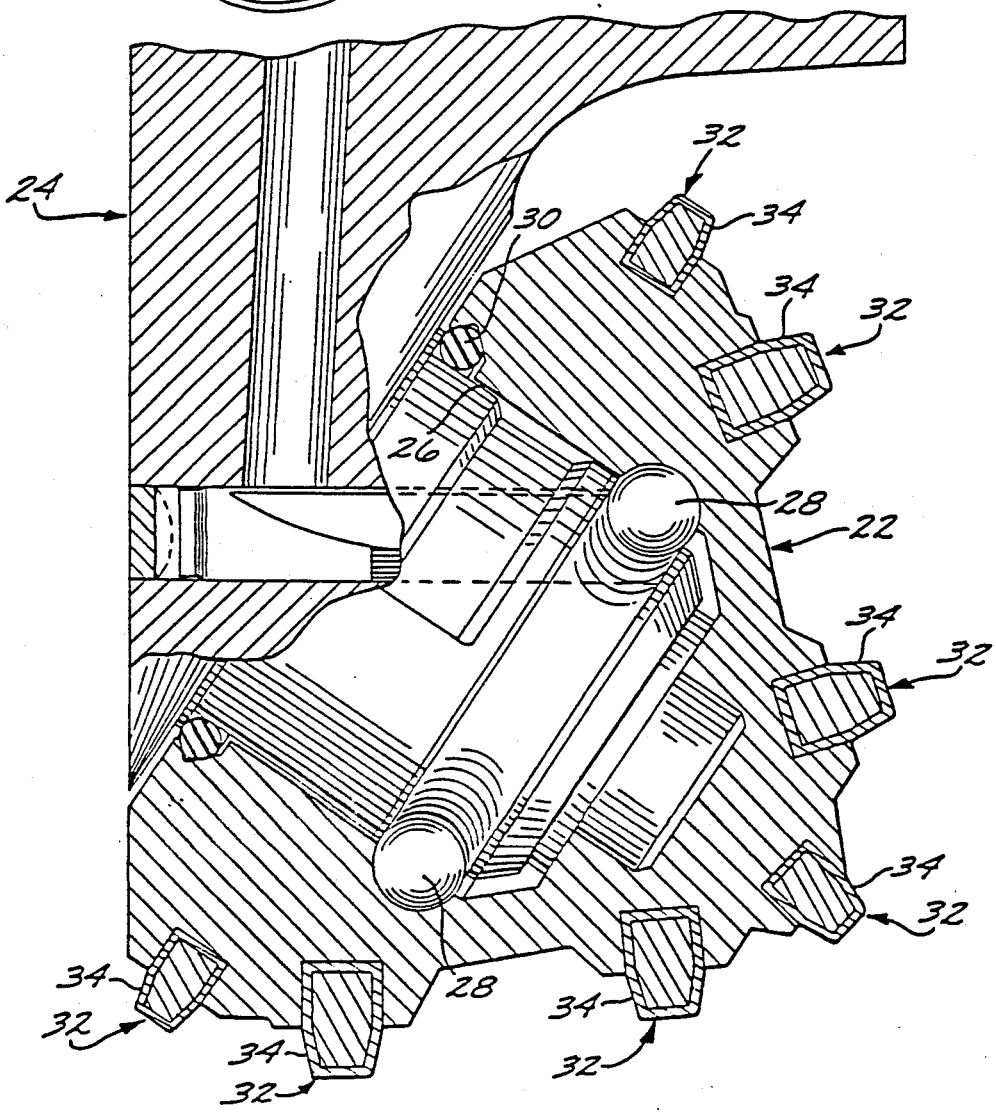

CAST STEEL ROCK BIT CUTTER CONES HAVING METALLURGICALLY BONDED CUTTER INSERTS

CROSS-REFERENCE TO RELATED APPLICATION

This application is a continuation-in-part application of application Ser. No. 076,510, filed July 22, 1987, now abandoned, which is a continuation application of Ser. No. 897,947, filed Aug. 19, 1986, now abandoned, which is a continuation application of Ser. No. 655,140, filed Sept. 27, 1984, now abandoned.

BACKGROUND OF THE INVENTION

1. Field of the Invention

The present invention is directed to innovations in the manufacture of rock bits. More particularly, the present invention is directed to cast steel rock bit cutter cones into which hard cement cutting inserts are incorporated during the casting process.

2. Brief Description of the Prior Art

Rock bit cutter cones having cemented carbide-type cutter inserts are, generally speaking, used for drilling in subterranean formations under conditions where other drilling cones, such as "milled tooth" cones, would provide relatively low rates of penetration and shorter bit runs. The hard cutter inserts incorporated into rock bits typically comprise cermets, such as tungsten carbide (or other hard metal carbide) in a metal binder phase. The most frequently used cutter inserts for rock bits comprise tungsten carbide in a cobalt binder (WC-Co).

In accordance with typical prior art practice for the preparation of cutter cones having cermet inserts, the steel cutter cones are made first by forging. Thereafter, holes are drilled into the steel cutter cone for accepting the cermet cutter inserts. The cutter inserts usually have a cylindrical base and are usually mounted into the holes with an interference fit. This method of mounting the cutter inserts to the cone is not entirely satisfactory, however, because it is labor intensive. Moreover, the inserts are often dislodged and lost from the cone due to excessive forces, repetitive loads, and shocks which unavoidably occur during subterranean drilling.

With regard to the foregoing, it should be recognized by those skilled in the art that retention of the inserts in the cone is highly dependent on the yield strength of the cone materials. However, in conventional cones, it is not possible nor practical to increase the retention beyond a certain upper limit because increasing yield strength usually results in lowered fracture toughness, potentially leading to cone cracking in service. Therefore, the acceptable upper limit of the yield strength of the cone is limited by the fracture toughness of such material and therefore rock bit insert retention through interference techniques is consequently limited.

In light of the foregoing and in an effort to improve the attachment of the cutter inserts to the cutter cones, the prior art has devised several techniques. For example, U.S. Pat. No. 4,389,074 describes brazing tungsten carbide cobalt inserts into a mining tool with a brazing alloy.

U.S. Pat. No. 3,294,186 describes mounting of tungsten carbide cobalt inserts into rock bits using a layer of a brazing alloy, a nickel shim, and yet another layer of a brazing alloy. This referenced patent is directed simply to a rock bit which has slots into which carbide cutting tips are mounted. The carbide tips are centered in the slots of the prefabricated steel body of the rock bit between two nickel shims, or between two copper shims. A layer of a brazing alloy is placed between the shims and the carbide tip, and also between the shims and the prefabricated steel body of the rock bit. (See Column 1, lines 38–42, of the Buell '186 patent.) The procedure described in this patent, however, is very labor intensive because the brazing is performed in connection with each insert after the cutter cone, having the appropriate apertures for the inserts, has already been formed by conventional techniques.

In sharp contrast o the structure described in the Buell '186 prior art patent, in the present invention the carbide (cermet) inserts are first coated with a suitable metal (preferably nickel or nickel alloy). Thereafter, a steel body of the rock bit is cast to partially embed the inserts. In some preferred embodiments, the cermet inserts are coated first with a copper and thereafter with a nickel layer. Only after these two coats are complete is the steel body of the rock bit cast on the insert. Thus, the steel is metallurgically bonded to the external coating (nickel) during the casting process, where very minor alloying of the steel and the external coating occurs. No intermediate layer of brazing alloy between the nickel and steel is present.

When casting steel, the nickel layer that's adjacent to the steel will also get heated and partially melts. Depending on the rate of diffusion of alloying elements across the nickel-steel interface, an alloy composition with a lower melting point than either the steel or the nickel is formed. At the casting temperature, this phase is molten and solidifies as a new solid phase (a metallurgical phase). This implies that the nickel is metallurgically bonded to the steel. The bonding occurs in the layers that are in intermediate contact. In essence, when two metals (steel and nickel) come in contact at temperature, diffusion of alloying elements occurs from nickel into steel and from steel into nickel. When this happens the layers that are in immediate contact form a metallurgical phase which has a lower liquidous state than either nickel or steel and therefore at the casting temperature, these melt and solidify and form a new phase. Thus, you have a metallurgical bond across that interface. It is not just a mechanical bond between steel and nickel as is common in the prior art. To amplify this further, if you look at a chemical analysis profile across the steel nickel interface you have, on one side, a 100% steel. As you approach the interface you are going to have an alloy which is steel-nickel, rich in steel, poor in nickel. As you go across the interface you will have the same alloy richer in nickel, poorer in steel and away finally to the region that is adjacent to an insert, it is going to be a 100% nickel. So what you really have is a chemical gradient which is also a metallurgical gradient and therefore, it is again, a metallurgical bond. The extent of melting is going to depend on many factors. It is going to depend on the material solubility of the steel and the nickel, and the temperature that the casting is poured, it is going to also depend on the surface oxides present on the steel (contaminants tend to lower the liquidous, but also, affect the mutual solubility of one element in the other).

The prior art has used brazing alloys as intermediate layers. To emphasize these brazing alloys (such as solder) are low temperature materials, which means they do not alloy with the steel or they do not alloy with the substrate since, at these temperatures, melting of steel does not occur. These low temperature alloys are physically, just in surface contact. These brazing alloys form a liquid phase within themselves without mingling with the steel. There is no co-mingling between the steel and the solder (in this case of the braze) so the interface really is not a metallurgical bond. It is a mechanical bond. Again, if you were to use the same analog as was done earlier in which a chemical profile was taken across an interface with the braze, what you will have is 100% steel and then you have a discrete interface, then 100% braze. There is not going to be an intermediate layer where there is a mixture of braze and steel. There is no diffusion of species or co-mingling of species across the interface which makes it a mechanical bond not a metallurgical bond.

Another approach taken by the prior art to improve the mounting of cutter inserts to the cutter cones is to provide a widened, reverse taper base for the cutter inserts. Such inserts are mounted into the cutter cones by embedding the insert in a suitable metal powder and thereafter forming the cutter cone through powder metallurgy processes.

A significantly improved rock bit cutter cone, having strongly bonded cutter inserts, is described in U.S. Pat. No. 4,593,776 which is assigned to the same assignee as the present application. The cutter cone of the invention described in the '776 patent has a steel core covered by a hard cladding formed by a suitable powder metallurgy process. Hard cermet cutter inserts are mounted into holes or openings provided in the steel core. The inserts are metallurgically bonded to the core and cladding during the hot isostatic pressing or like process in which the cladding is consolidated.

Still other techniques for affixing tungsten carbide inserts to drill bodies, tools and the like are described in U.S. Pat. Nos. 1,926,770 and 3,970,158.

A problem encountered in the prior art in connection with cermet cutter inserts, and particularly tungsten carbide cobalt (WC-Co) cutter inserts relates to the formation, under certain conditions, of undesirable metallurgical phases, such as a brittle "eta" phase, in the WC-Co cutter inserts. More specifically, when the cermet insert surrounded by steel, such as a WC-Co insert mounted into a steel rock bit cutter cone, is heated to high temperature, the above-noted "eta" phase is formed in the insert, and the toughness and durability of the insert deteriorates significantly.

As is well understood by those skilled in the metallurgical sciences, the "eta" phase is formed in the tungsten carbide cobalt insert by Fick's Law diffusion of carbon from the insert into the surrounding steel cone matrix. Essentially, the relatively high carbon content of the tungsten carbide cobalt insert, and the high affinity of the adjacent steel for carbon, provide the driving force for the above-noted diffusion, and cause the attendant deterioration of the insert.

Except for the above-mentioned U.S. Pat. No. 4,593,776, the prior art was by and large unable to prevent the formation of undesirable "eta" phase in WC-Co cutter inserts under the above-noted conditions. The foregoing provides perhaps the principal reason why, up to the present invention, the majority of rock bit cutter cones which had WC-Co cutter inserts, had the inserts merely interference fitted in insert holes previously formed in the steel cone of the rock bit.

Moreover, even though it has been considered desirable to have a thermal barrier on the insert for minimizing or eliminating thermally generated fracture associated with casting, as well as retarding or eliminating "eta" phase formation, the prior art was limited in this regard to titanium nitride and titanium carbide coated inserts. The titanium nitride and titanium carbide coated inserts, however, are not bonded to the resulting steel matrix by metallurgical bonds. Therefore, often they are held loosely and, under harsh conditions, are likely to rotate, to be lost, or to initiate cracking in the steel matrix.

SUMMARY OF THE INVENTION

It is an object of the present invention to provide a tool having hard metal carbide cutter inserts in a steel matrix, wherein the cutter inserts are affixed in the matrix by metallurgical bonds.

It is another object of the present invention to provide rock bit cutter cones with hard metal carbide cutter inserts embedded in the steel cutter cones and forming metallurgical bonds with the adjacent matrix.

It is still another object of the present invention to provide rock bit cutter cones with solidly embedded tungsten carbide cobalt inserts, wherein undesirable "eta" phase is substantially eliminated from the inserts.

It is yet another object of the present invention to provide a relatively economical process for fabricating cast steel tools having solidly embedded hard metal carbide cutter inserts.

It is a further object of the present invention to provide a relatively economical process for fabricating cast steel rock bit cutter cones having solidly embedded tungsten carbide cobalt cutter inserts wherein undesirable deterioration of the inserts due to "eta" phase formation is substantially eliminated.

It is still a further object of the present invention to provide a process for fabricating such bit cutter cones of high structural integrity wherein thermal cracking is substantially eliminated in the process of casting the cones and embedding metal carbide cutter inserts in the cone.

The foregoing and other objects and advantages are attained by a steel tool, such as a rock bit cutter cone, wherein one or several hard metal carbide cutter inserts have a coating of a suitable metal disposed between the inserts and the cast steel matrix of the tool.

The inserts can be made of tungsten carbide in a cobalt binder, tungsten carbide in an iron binder, tungsten carbide in an iron-nickel binder, tungsten carbide in an iron-nickel-cobalt binder, nonstochiometric tungsten molybdenum carbide in a cobalt binder, nonstochiometric tungsten molybdenum carbide in an iron-nickel binder, or nonstochiometric tungsten molybdenum carbide in an iron-nickel-cobalt binder. Most frequently, the inserts are made of tungsten carbide in a cobalt binder phase.

The inserts are coated or plated with a metal layer or layers which partially melts at the temperature at which the steel matrix of the tool is cast. Preferred metal of the coating is nickel, but other suitable metals include nickel alloys, titanium, titanium alloys, irridium, irridium alloys, tungsten, tungsten alloys, rhodium, rhodium alloys, osmium, osmium alloys, niobium, niobium alloys, molybdenum, molybdenum alloys, chromium, and chromium alloys. The coating is preferably deposited on the inserts by electroplating. An additional coating of copper or copper alloys is preferably also deposited on the inserts beneath the coating of the above-noted high melting metals.

During fabrication of the steel tool, the coated inserts are held in a suitable mold and the steel body of the tool is then poured in accordance with substantially standard casting procedures. The coating or plating of the inserts accomplishes the following. Thermal shocks in the inserts due to process cycling are minimized or eliminated. Diffusion of carbon from the inserts into the surrounding steel matrix is eliminated or at least mimimized, and the inserts are metallurgically bonded to the steel matrix in the resulting tool.

A combination of a coating of copper and a coating of nickel on tungsten carbide cobalt inserts is particularly advantageous for the fabrication of rock bit cutter cones having such cermet cutter inserts because undesirable "eta" phase formation through carbon diffusion is effectively eliminated in the inserts by the copper coating, and the nickel coating binds the inserts to the steel core of the tool through metallurgical bonds.

The above noted objects and advantages of the present invention will be more fully understood upon a study of the following description in conjunction with the detailed drawings.

BRIEF DESCRIPTION OF THE DRAWINGS

FIG. 1 is a perspective view of a rock bit incorporating the cutter cone of the present invention;

FIG. 2 is a partial cross-sectional view of a journal leg of a rock bit with the cutter cone of the present invention mounted thereon;

Figure 3:
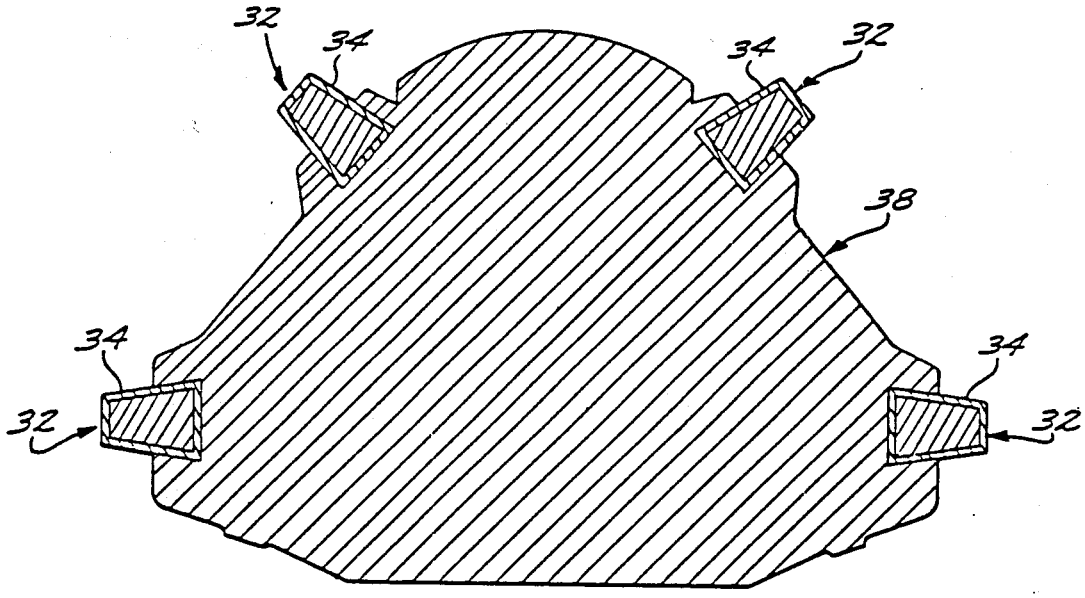
FIG. 3 is a schematic cross-sectional view of an intermediate in the fabrication of the cutter cone of the present invention, the intermediate having a solid core.

DESCRIPTION OF THE PREFERRED EMBODIMENTS AND BEST MODE FOR CARRYING OUT THE INVENTION

The following specification, taken in conjunction with the drawings, set forth the preferred embodiments of the present invention. The embodiments of the invention disclosed herein are the best modes contemplated by the inventors for carrying out their invention in a commercial environment although it should be understood that various modifications can be accomplished within the scope of the present invention.

It is noted at the outset of the present description that the present invention broadly encompasses novel construction of cast steel tools which incorporate "hard" metal carbide cutter inserts. Therefore, various kinds of tools to be used, for example in material cutting and shaping operations, may be constructed in accordance with the present invention. The scope of the present invention is not limited by the precise nature of the tool.

A principal application of the present invention is, however, for the construction of rock bit cutter cones which incorporate a plurality of hard metal carbide cutter inserts. Therefore, the invention is described principally in connection with such rock bit cutter cones.

Referring now to FIG. 1 of the appended drawings, a rock bit 20 of the type which incorporates three of the cutter cones 22 of the present invention is shown. The partial cross-sectional view of FIG. 2 illustrates one journal leg 24 of the rock bit 20, to which the cutter cone 22 of the present invention is mounted. Because the overall mechanical configuration of the rock bit 20 is conventional in most respects, it is disclosed here only briefly to the extent necessary to explain and illustrate the present invention. For a detailed description of the conventional features of rock bits, the specifications of U.S. Pat. No. 4,358,384 is incorporated herein by reference.

Thus, the rock bit 20 includes three journal legs 24, and a cutter cone 22 mounted on each journal leg 24. The cutter cone 22 and the journal leg 24 are provided with suitable bearings 26 so that the cutter cone 22 can rotate on the journal leg 24. A plurality of balls 28 secure the cutter cone 22 to the journal leg 24. The bearings 26 are usually lubricated by an internal supply (not shown) of lubricant (not shown), and the bearings 26 are sealed with an elastic seal 30 against entry of extraneous material such as drilling mud (not shown).

A plurality of "hard" metal carbide cutter inserts 32 are mounted to each cutter cone 22 of the rock bit 20, as is shown on FIGS. 1, 2 and 3. More specifically, the cutter inserts 32 consist of cermet materials, that is, hard metal carbides incorporated in a suitable metal binder phase. The cermet cutter inserts 32 are harder than the metal body of the cutter cone 22. The hard cutter inserts 32 provide the cutting or drilling action in the subterranean formation (not shown), as the entire rock bit 20 is rotated by a power source such as a rotary table (not shown) or down hole drilling motor (not shown), about the nominally vertical axis of the rock bit 20.

In accordance with the present invention, the cutter inserts 32 are incorporated into the cutter cone 22 by a casting technique. To this end, the cutter inserts 32 are coated with a layer or coating 34 of a metal or metal alloy which does not significantly melt at the temperature at which the steel cutter cone 22 is cast.

The most frequently used cutter inserts 32 consist substantially of tungsten carbide in a cobalt binder (WC-Co). Other cermets which are sufficiently hard and suitable for use as cutter inserts in connection with the present invention include tungsten carbide in an iron binder, tungsten carbide in an iron-nickel binder, tungsten carbide in an iron-nickel-cobalt binder, nonstochiometric tungsten molybdenum carbide in a cobalt binder, nonstochiometric tungsten molybdenum carbide in an iron-nickel binder, and nonstochiometric tungsten molybdenum carbide in an iron-nickel-cobalt binder.

Figure 4:
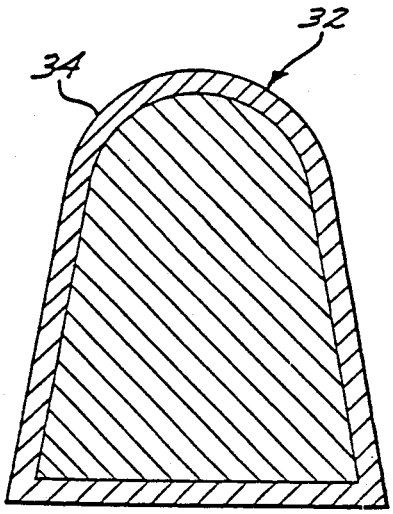
FIG. 4 is a schematic cross-sectional view of a coated cutter insert which is to be incorporated into the cutter cone of the present invention.
Figure 5:
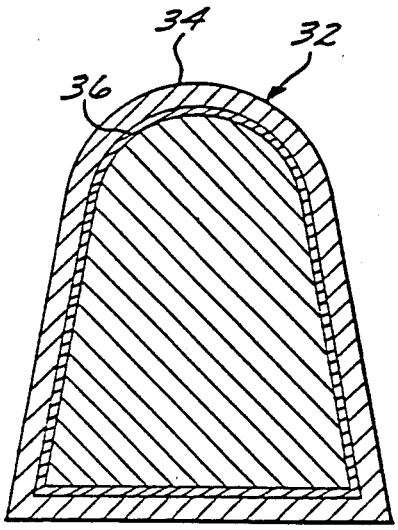
FIG. 5 is a schematic cross-sectional view of another embodiment of a coated cutter insert which is to be incorporated into the cutter cone of the present invention.

Typically, cutter inserts 32 employed in the present invention are of a substantially cylindrical configuration, as is shown in FIGS. 1 and 2, or of a tapered, conical configuration, as is shown in FIGS. 3, 4 and 5. The inserts 32 are typically and approximately one inch tall and have a base diameter of approximately one-half inch.

FIG. 4 shows the layer or coating 34 of metal which is disposed on the cutter insert 32 in accordance with the present invention. The metal of the coating 34 is preferably nickel or a suitable nickel alloy. However, as it was noted above, the principal requirement with regard to the coating 34 is that it does not completely or even significantly melt while the cast steel cone 22 is poured by conventional casting techniques. What is meant in this regard is that the melting temperature of the metal of the coating 34 may be higher than the temperature of the molten steel poured in the casting step or the coating will be of sufficient thickness such that it does not fully melt under the implicit casting conditions. However, as it will be readily understood by those skilled in the art, a portion of the metal layer or coating 34 may nevertheless melt under these circumstances due to lowering of the melting temperature at the interface of the metal coating 34 and the molten steel.

Metals or alloys other than nickel or nickel alloys, although less preferred, are nevertheless suitable for the coating 34 and include titanium, titanium alloys, iridium, irridium alloys, tungsten, tungsten alloys, rhodium, rhodium alloys, osmium, osmium alloys, niobium, niobium alloys, molybdenum, molybdenum alloys, chromium, and chromium alloys.

The coating 34 can be deposited on the cermet cutter inserts 32 by several techniques which include electroplating, chemical vapor deposition, sputtering, spray coating followed by fusion, and electroless plating. Principal requirements in this regard are that the coating 34 should be nonporous and of relatively uniform thickness. Electroplating is the preferred technique for depositing the coating 34 on the cutter inserts 32. It will be readily recognized by those skilled in the art in this regard that due to conventional equipment and process limitations, not all of the above-noted metals or metal alloys can be applied to the inserts by each of the above-noted coating or plating processes.

One function of the coating or layer 34 of high melting metal or metal alloy on the cutter insert 32 is to avoid or minimize thermal shock in the cermet cutter insert 32 when the cast steel cutter cone 22 is poured.

Another function of the coating 34 is to prevent degradation of the material of the cutter insert 32 when the cutter insert 32 is exposed to high temperature during the casting of the steel cone 22. As it was noted in the introductory section of the present application for patent, such degradation usually occurs due to carbon diffusion and "eta" phase formation when the commonly used tungsten carbide cobalt (WC-Co) inserts are exposed to high temperature in a steel environment. Thus, the other function of the coating 34, particularly when used on tungsten carbide cobalt (WC-Co) inserts, is to substantially prevent carbon diffusion and substantially eliminate "eta" phase formation in the cutter insert 32.

As previously discussed in the prior art section of carbide (cermet) inserts are first coated with a suitable metal (preferably nickel or nickel alloy). Thereafter, a steel body of the rock bit is cast to partially embed the inserts. In some preferred embodiments, the cermet inserts are coated first with copper, followed by a nickel layer. Only after these two coats are complete is the steel body of the rock bit cast on the insert. Thus, the steel is metallurgically bonded to the external coating (nickel) during the casting process, where very minor alloying of the steel and the external coating occurs. There is no intermediate layer of brazing alloy between the nickel and the steel.

Thickness of the coating 34 is selected to serve the foregoing functions and objectives. Therefore, the thickness of the coating 34 is dependent on the pouring or casting temperature of the cast steel cone 22, and the actual melting temperature of the metal or metal alloy which comprises the coating 34.

An electroplated nickel coating 34, of approximately 0.001" to 0.015", preferably of approximately 0.006" to 0.008", on tungsten carbide cobalt (WC-Co) inserts 32 of approximately one-half inch base diameter and approximately one inch height, was found in practice to be well suited to accomplish the above-noted functions and objectives. A further advantage of the nickel coating 34 on the inserts 32 is that the nickel forms a transition layer between the cermet insert 32 and the steel cone 22 in the resulting cast steel cones 22. The nickel coating 34 aids in metallurgically bonding the insert 32 to the cone 22.

Referring now to FIG. 5, a hard cermet insert 32 is shown which has a coating or layer 36 of copper, or copper alloys, disposed beneath the layer 34 of the higher melting metal, such as nickel. A tungsten carbide cobalt insert, having a copper layer 36 beneath a nickel layer 34, such as the one shown on FIG. 5, is particularly advantageous because copper has a very strong tendency to prevent diffusion of carbon and prevents the formation of undesirable "eta" phase in the insert.

The copper layer 36 may be deposited on the insert 32 by the same techniques as the layer 34 of the higher melting metal or metal alloy. Electroplating is also the preferred procedure for depositing the copper layer 36 on the inserts 32. The copper layer 36 on the insert 32 is usually less thick than the layer 34 of high melting metal or metal alloy. Typical thickness of the copper layer 36 is in the 0.0001" to 0.001" range.

In accordance with the present invention, the coated inserts 32, such as the copper and nickel coated tungsten carbide cobalt (WC-Co) inserts shown on FIG. 5, are placed in a suitable mold (not shown). The steel body of the cutter cone 22 is then cast by conventional casting techniques. Steels employed in this casting step include the steels commonly used for making cast steel rock bit cutter cones, such as steels of AISI 9315, EX 55, AISI 4815, and EX 30 designation. When these steels are used for the rock bit cutter cones, a subsequent carburization step is usually included in the overall process of manufacturing the cutter cone 22. This is described in more detail below.

Alternatively, other steel types, such as AISI 4320, 4330, 4340, and 300M can also be used for the cones. After casting, these latter steel types are surface hardened by techniques other than carburizing, such as austenitizing through induction heating, or by electron or laser beam heating followed by rapid cooling, as is described in U.S. Pat. No. 4,303,137, the specification of which is hereby incorporated by reference.

Preferably, the coated cutter inserts 32 are preheated, usually in an inert gas or slightly reducing atmosphere, to approximately 200° to 600° C. prior to the casting step, in order to further minimize thermal shock to the inserts 32.

FIG. 3 of the drawings shows a cutter cone 38 in accordance with the present invention, after the casting step. As is shown on the drawing figure, the cutter inserts 32 are of a tapered, conical configuration. This configuration of the inserts 32 further assures their secure mounting to the cutter cone 38. As it will be readily appreciated by those skilled in the art, cutter inserts 32 of such conical configuration cannot be mounted into performed holes of cutter cones by mere interference or friction fit.

The cutter cones 38 shown on FIG. 3 will be readily recognized by those skilled in the art as an intermediate, which still must be subjected to machining and other operations to form the final cutter cone 22 to be mounted on the rock bit journal 24. One such step commonly employed for making the final cutter cone 32 is carburizing the exterior of the cone 32. In accordance with some manufacturing procedures, certain interior bearing surfaces of the cone 32 may also be carburized.

During such carburization steps, the combined copper and nickel coatings 36 and 34 on the inserts 32 also serve as substitutes for "stop off" paint, and eliminate the requirement for the extra step of applying "stop off" paint on the individual inserts 32.

The copper and nickel coatings 36 and 34 are, of course, readily removed from the exposed portions of the inserts 32 during initial stages of subterranean operation of the rock bit 20.

Tests indicate that substantially larger pulling forces are required to remove the inserts 32 from the cutter cone 22 of the present invention than from prior art cutter cones where the inserts 32 are held merely by interference fit and friction forces.

Several modifications of the novel "hard" cermet insert containing cast steel tools, and particularly of the rock bit cutter cones, may become readily apparent to those skilled in the art in light of the above disclosure.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A cutting tool to be used for shaping of materials, the tool comprising:

at least one hard cermet insert forming a first base end and a second cutting end, said insert comprising a metal carbide in a suitable metal binder phase;

a first metal layer disposed on the first base end of the cermet insert, said metal layer being selected from a group consisting of copper and copper alloys;

a second high temperature protective metal layer disposed on top of said first copper metal layer; and a steel matrix surrounding said first base end of the cermet insert, the matrix having been cast in a molten state into a suitable mold while the base end of the layered cermet insert is held in the mold in operative position while the molten steel encompasses said base of said insert, the metal of the first copper layer forms a barrier to block diffusion of carbon from the insert into the surrounding steel matrix during the casting process, the second high temperature metal layer protects the first copper layer of metal, the surface of the high temperature layer partially melts at the temperature of the molten steel matrix, the steel matrix is thereby metallurgically bonded to the second high temperature layer.

2. The tool of claim 1 wherein the cermet insert is selected from a group consisting of tungsten carbide in a cobalt binder, tungsten carbide in an iron binder, tungsten carbide in an iron-nickel-cobalt binder, nonstochiometric tungsten molybdenum carbide in a cobalt binder, non-stochiometric tungsten molybdenum carbide in an iron-nickel binder, and nonstochiometric tungsten molybdenum carbide in an iron-nickel-cobalt binder.

3. The tool of claim 1 wherein the metal of the second layer is selected from a group consisting of nickel, nickel alloys, titanium, titanium alloys, irridium, irridium alloys, tungsten, tungsten alloys, rhodium, rhodium alloys, osmium, osmium alloys, niobium, niobium alloys, molybdenum, molybdenum alloys, chromium, and chromium alloys.

4. The tool of claim 3 wherein each of the first and second metal layers on the cermet insert is approximately 0.001 to 0.015 inch thick.

5. A rock bit cutter cone comprising:

a cast steel core;

a plurality of hard metal carbide cermet cutter inserts, each insert forming a first base end and a second cutting end, the base end of the insert is partially embedded and held in the steel core;

a first intermediate layer of metal disposed on said first base end of said cermet inserts, said metal being selected from a group consisting of copper and copper alloys; and a second high temperature protective layer of metal disposed on top of the first intermediate layer of metal on the first base end of said cermet inserts, the embedding steel core having been cast thereafter in a suitable cutter cone mold in a molten state to partially embed the first base end of the cermet inserts in the steel core, the copper metal of the first layer serves as a barrier to block the diffusion of carbon from the cermet inserts into the surrounding steel core during the casting process, the high temperature metal of the second layer protects the first copper layer of metal, the surface of the high temperature layer partially melts at the temperature employed for casting the steel core thereby metallurgically bonding the steel core to the cermet insert.

6. The rock bit cutter cone of claim 5 wherein said hard metal carbide cermet cutter inserts are selected from a group consisting of tungsten carbide and nonstochiometric tungsten molybdenum carbide.

7. The rock bit cutter cone of claim 5 wherein the cermet cutting inserts are of a material selected from a group consisting of tungsten carbide in a cobalt binder, tungsten carbide in an iron binder, tungsten carbide in an iron-nickel binder, tungsten carbide in an iron-nickel-cobalt binder, nonstochiometric tungsten molybdenum carbide in a cobalt binder, nonstochiometric tungsten molybdenum carbide in an iron-nickel binder, and nonstochiometric tungsten molybdenum carbide in an iron-nickel-cobalt binder.

8. The rock bit cutter cone of claim 7 wherein the high temperature protective metal of the second layer is selected from a group consisting of nickel, nickel alloys, titanium, titanium alloys, irridium, irridium alloys, tungsten, tungsten alloys, rhodium, rhodium alloys, osmium, osmium alloys, niobium, niobium alloys, molybdenum, molybdenum alloys, chromium, and chromium alloys.

9. The rock bit cutter cone of claim 5 wherein each of the first and second metal layers is approximately 0.001 to 0.015 inch thick.

* * * * *